US005486029A

United States Patent [19]

Kobayashi

[11] Patent Number: 5,486,029

[45] Date of Patent: Jan. 23, 1996

[54] APPARATUS FOR MANIPULATING CHOPSTICKS

[76] Inventor: David Kobayashi, 12404 Yellowhead Trail, Edmonton, Alberta, Canada, T5L 4S4

[21] Appl. No.: 375,671

[22] Filed: Jan. 20, 1995

[51] Int. Cl.[6] ..... A47G 21/10; A47J 43/28

[52] U.S. Cl. ..... 294/99.2; 294/33

[58] Field of Search ..... 294/1.1, 7, 8.5, 294/11, 33, 99.2; 24/462, 501, 530; 30/142, 150, 322; D7/642, 645, 686

[56] References Cited

U.S. PATENT DOCUMENTS

| | | | |
|---|---|---|---|
| D. 343,096 | 1/1994 | Lachapelle | D7/642 |
| 3,186,749 | 6/1965 | Dawes | 294/99.2 |
| 3,239,262 | 2/1966 | Rines et al. | 294/99.2 |
| 3,323,825 | 6/1967 | Arima | 294/99.2 |
| 3,637,248 | 1/1972 | Arita | 294/99.2 |
| 4,223,936 | 9/1980 | Jorgensen | 294/99.2 |
| 4,721,334 | 1/1988 | Nakatsu | 294/99.2 |

FOREIGN PATENT DOCUMENTS

WO93/12701 7/1993 WIPO .

*Primary Examiner*—Johnny D. Cherry

*Attorney, Agent, or Firm*—Douglas Thompson; Thompson Lambert

[57] ABSTRACT

An apparatus for manipulating chopsticks is described which can be easily manufactured out of a polymer plastic tube, such as a drinking straw. The tube or straw is divided into a central portion and two wing portions by two transverse cuts. The size of the central portion is selected in accordance with a desired spacing between two chopsticks. Each of the wing portions has an axially extending bore of a size sufficient to accommodate a chopstick in friction fit relation. The transverse cuts extend only partially through the thickness of the tubular body leaving connective strips between the central portion and each of the two wing portions that serve as living hinges.

2 Claims, 3 Drawing Sheets

APPARATUS FOR MANIPULATING CHOPSTICKS

FIELD OF THE INVENTION

The present invention relates to an apparatus for manipulating chopsticks.

BACKGROUND OF THE INVENTION

Chopsticks are oriental eating utensils consisting of two separate sticks which must be coordinated in movement and alignment by the thumb and adjacent fingers of one hand. The sticks are pivoted by the fingers to clamp food between the lower ends thereof. Chopsticks can be difficult and frustrating to use for novice users or persons suffering from a disability.

A number of inventions have been developed in order to assist novice users to more fully enjoy their oriental dining experience. U.S. Pat. No. 3,239,262 granted to Rines et al in 1966 discloses an invention entitled a "chopstick hinge". The chopstick hinge consists of a pair of chopstick receiving sleeves connected by what is described as a "C-shaped neck". U.S. Pat. No. 3,323,825 granted to Arima in 1967 discloses an invention entitled a "chopstick manipulator". The chopstick manipulator consists of a casing with a pair of chopstick receiving openings extending therethrough. One of the chopsticks is pivotally movable relative to the other of the chopsticks, with such movement being controlled by means of a spring. International application PCT/GB92/02409 by Ball published under the Patent Cooperation Treaty in 1993 as International Publication Number WO 93/12701 discloses an invention described as relating to "chopsticks, and in particular to a device for facilitating the use thereof". The Ball reference discloses what is described as a "resilient member" having two chopstick receiving holes. The resilient members serves to resiliently bias apart the lower ends of the chopsticks that are normally used to pick up food.

Oriental restaurants could use an apparatus to assist novice users in manipulating chopsticks that is sufficiently simple in construction to enable it to be produced at a cost low enough that it can be disposed of after every use. At the same time the apparatus must be sufficiently effective to relieve the frustration of novice chopstick users. The above described references have not been able to effectively fulfil both of these requirements.

SUMMARY OF THE INVENTION

What is required is an effective and low cost apparatus for manipulating chopsticks.

According to one aspect of the present invention there is provided an apparatus for manipulating chopsticks which includes a tubular polymer plastic body divided into a central portion and two wing portions by two transverse cuts. The size of the central portion is selected in accordance with a desired spacing between two chopsticks. Each of the wing portions has an axially extending bore of a size sufficient to accommodate a chopstick in friction fit relation. The transverse cuts extend only partially through the thickness of the tubular body leaving connective strips between the central portion and each of the two wing portions that serve as living hinges.

With the apparatus for manipulating chopsticks, as described above, chopsticks are friction fit into the axial bores of the wing portions. The central portion maintains chopstick spacing. The connective strips serve as living hinges that pivot back and forth as the lower ends of the chopsticks are manipulated.

According to another aspect of the present invention there is provided a method of manufacturing an apparatus for manipulating chopsticks. It is contemplated that the apparatus for manipulating chopsticks can easily be manufactured for a fraction of a cent by a drinking straw manufacturer. Firstly, provide polymer plastic tubular stock having an axially extending bore of a size selected to accommodate a chopstick in friction fit relation; such as a drinking straw. Secondly, place two transverse cuts in the tubular stock to divide the tubular stock into a central portion and two wing portions. The size of the central portion is selected in accordance with a desired spacing between two chopsticks. The transverse cuts extend only partially through the thickness of tubular stock leaving connective strips between the central portion and each of the two wing portions that serve as a living hinge.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
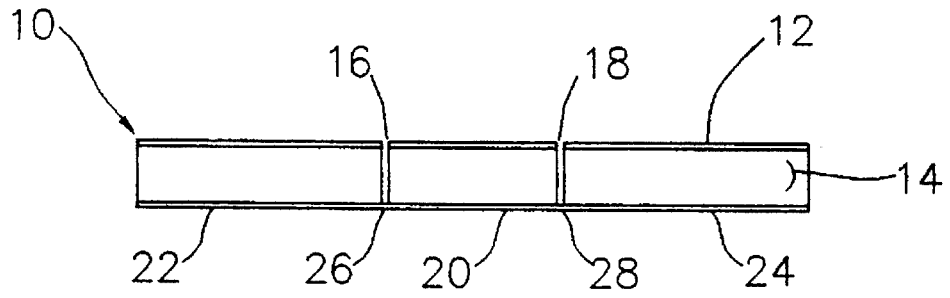
FIG. 1 is a side elevation view in section of an apparatus for manipulating chopsticks constructed in accordance with the teaching of the present invention.

The preferred embodiment, an apparatus for manipulating chopsticks generally identified by reference numeral 10, will now be described with reference to FIGS. 1 through 4.

Figure 3:
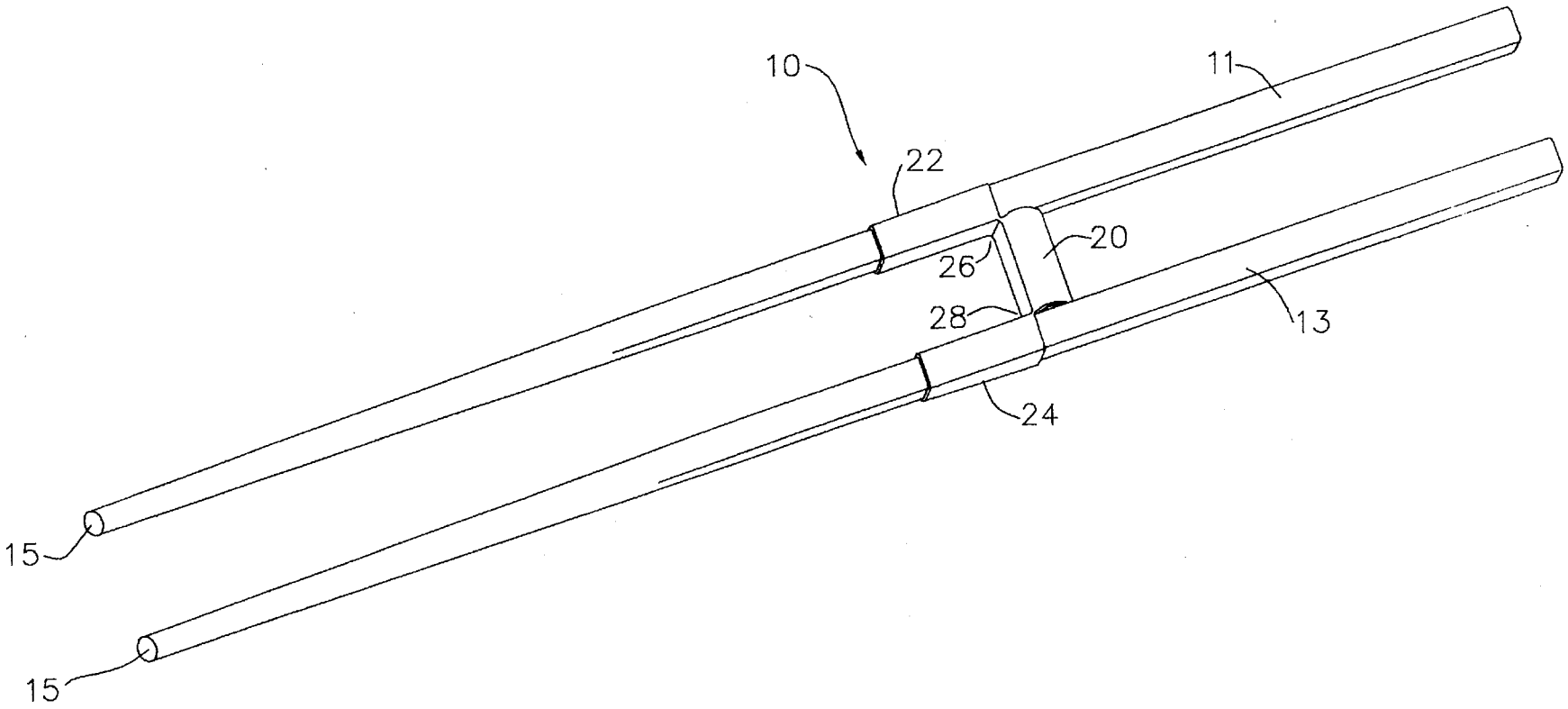
FIG. 3 is a perspective view of the apparatus for manipulating chopsticks illustrated in FIG. 1, with chopsticks inserted and the lower ends of the chopsticks in a spaced apart position.
Figure 4:
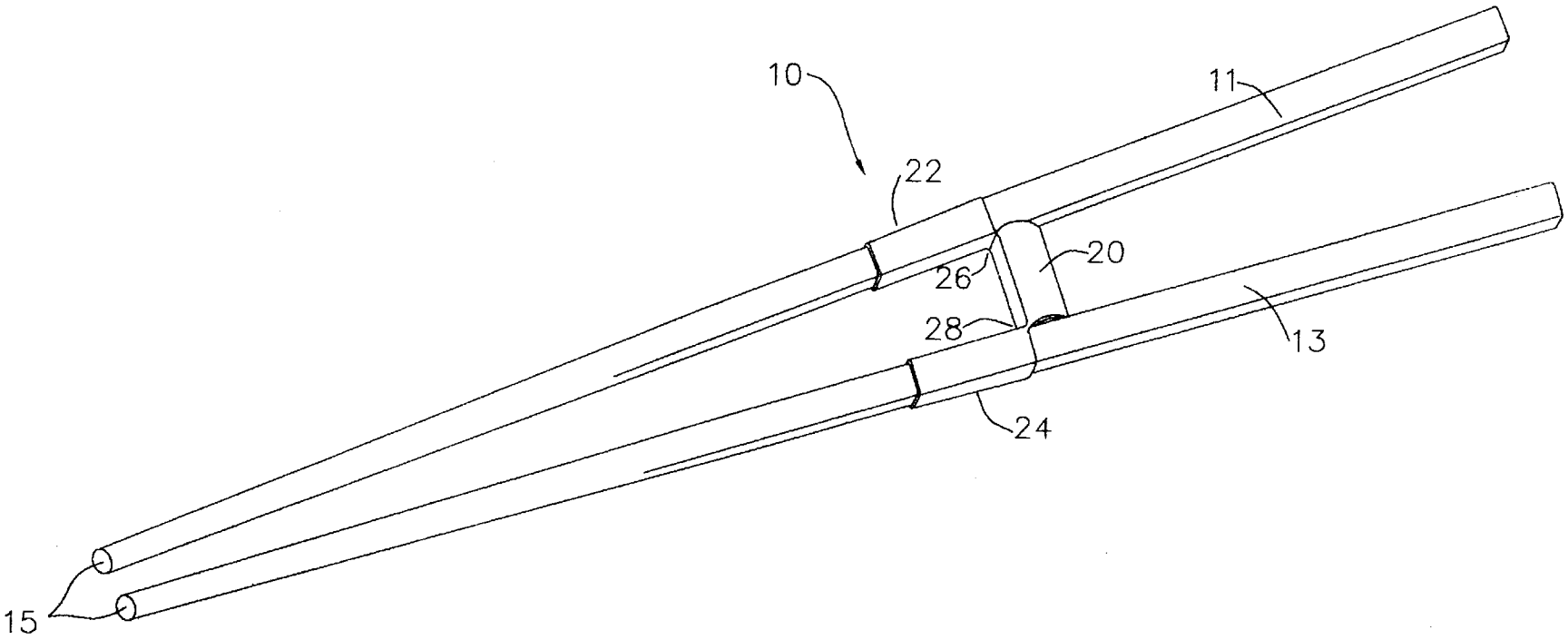
FIG. 4 is a perspective view of the apparatus for manipulating chopsticks illustrated in FIG. 1, with chopsticks inserted and the lower ends of the chopsticks in a food engaging position.

To aid in the description a pair of chopsticks 11 and 13 are illustrated in FIGS. 3 and 4. Each of chopsticks 11 and 13 has a lower food engaging end 15.

Referring to FIG. 1, apparatus 10 is manufactured in the following manner. Firstly, provide polymer plastic tubular stock 12, such as a plurality of drinking straws. Each of drinking straws 12 has an axially extending bore 14 of a size selected to accommodate chopsticks 11 and 13 in friction fit relation, as illustrated in FIGS. 3 and 4. Secondly, place two transverse cuts 16 and 18 in tubular stock 12 to divide tubular stock 12 into a central portion 20 and two wing portions 22 and 24. The size of central portion 20 is selected in accordance with a desired spacing between chopsticks 11 and 13. Transverse cuts 16 and 18 extend only partially through the thickness of tubular stock 12 leaving connective strips 26 and 28 between central portion 20 and wing portions 22 and 24, respectively. Connective strips 26 and 28 serve as living hinges, as will hereinafter be further described.

Figure 2:
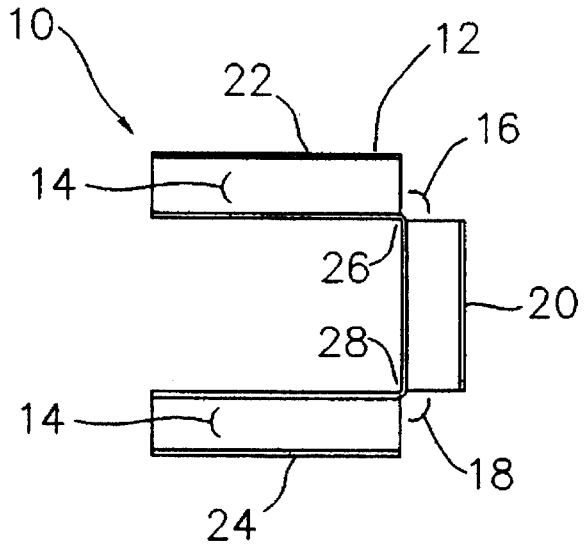
FIG. 2 is a too plan view in section of the apparatus for manipulating chopsticks illustrated in FIG. 1, with wing portions hinged about connective strips.

Referring to FIG. 2, apparatus for manipulating chopsticks 10 which results from such manufacturing process includes tubular polymer plastic body 12 divided into central portion 20 and wing portions 22 and 24 by transverse cuts, 16 and 18 respectively. Each of wing portions 22 and 24 has an axially extending bore 14 of a size sufficient to accommodate chopsticks 11 and 13, respectively, as illustrated in FIGS. 3 and 4, in friction fit relation. Transverse cuts 16 and 18 extend only partially through the thickness of tubular body leaving connective strips 26 and 28 between central portion 20 and wing portions 22 and 24, respectively, that serve as living hinges.

The use and operation of apparatus for manipulating chopsticks 10 will now be described with reference to FIGS. 1 through 4. Apparatus 10 is sold in the configuration illustrated in FIG. 1. In order to use apparatus 10, wing portions 22 and 24 are bent about connective strips 26 and 28 until apparatus 10 assumes a generally "U" shape as illustrated in FIG. 2. Chopsticks 11 and 13 are inserted into axial bores 14 of wing portions 22 and 24, respectively, assuming a combined configuration as illustrated in FIGS. 3 and 4. Care is taken to ensure that wing portions 22 and 24 point toward lower food engaging ends 15 of chopsticks 11 and 13. Lower food engaging ends 15 of chopsticks 11 and 13 are inserted into food (not shown) in a spaced apart position as illustrated in FIG. 3. The food is then clamped between lower food engaging ends 15 of chopsticks 11 and 13 by pivoting wing portions 22 and 24 about the living hinges provided by connective strips 26 and 28, respectively.

It will be apparent to one skilled in the art from reviewing the drawings and above description that in the absence of chopsticks 11 and 13, connective strips 26 and 28 cause wing portions 22 and 24 to spring back parallel to central portion 20 as illustrated in FIG. 1. Chopsticks 11 and 13 must be inserted in order for apparatus 10 to remain in the configuration illustrated in FIG. 2. Central portion 20 spaces chopsticks 11 and 13 a set distance apart. The elastic memory property of plastic connective strips 26 and 28 maintains chopsticks 11 and 13 in a substantially parallel position as illustrated in FIG. 3. A novice user can use the first two fingers of his or her hand to cause lower food engaging ends 15 to meet each other to grasp food, as illustrated in FIG. 4. When pressure is applied by the fingers of the novice user, connective strips 26 and 28 serve as living hinges. When pressure is released, chopsticks 11 and 13 return to the substantially parallel position illustrated in FIG. 3. It will also be apparent to one skilled in the art that apparatus for manipulating chopsticks 10, as described above, is simple and low cost to manufacture and yet provides excellent chopstick control. It will finally be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An apparatus for manipulating chopsticks, comprising:

a tubular polymer plastic body divided into a central portion and two wing portions by two transverse cuts, the size of the central portion being selected in accordance with a desired spacing between two chopsticks, each of the wing portions having axially extending bores of a size sufficient to accommodate a chopstick in friction fit relation, the transverse cuts extending only partially through the thickness of the tubular body leaving connective strips between the central portion and each of the two wing portions that serve as living hinges.

2. A method of manufacturing an apparatus for manipulating chopsticks, comprising the steps of:

firstly, providing polymer plastic tubular stock having an axially extending bore of a size selected to accommodate a chopstick in friction fit relation;

secondly, placing two transverse cuts in the tubular stock to divide the tubular stock into a central portion and two wing portions with the size of the central portion selected in accordance with a desired spacing between two chopsticks, the transverse cuts extending only partially through the thickness of tubular stock leaving connective strips between the central portion and each of the two wing portions that serve as a living hinge.

* * * * *